United States Patent [19]

Jaenson

[11] Patent Number: 4,484,518

[45] Date of Patent: Nov. 27, 1984

[54] TYING DEVICE

[75] Inventor: Howard W. Jaenson, Covina, Calif.

[73] Assignee: Jenglo Engineering, Inc., Azusa, Calif.

[21] Appl. No.: 558,206

[22] Filed: Dec. 5, 1983

[51] Int. Cl.[3] ..... B65B 13/24

[52] U.S. Cl. ..... 100/4; 100/26; 100/29; 100/33 R; 100/34; 140/101

[58] Field of Search ..... 100/3, 4, 8, 25, 26, 100/29, 32, 34, 33 R; 140/101, 111, 114

[56] References Cited

U.S. PATENT DOCUMENTS

| | | | |
|---|---|---|---|
| Re. 26,289 | 10/1967 | Neitzel . | |
| 1,732,619 | 10/1929 | Ryan . | |
| 1,947,918 | 2/1934 | Paxton . | |
| 2,612,833 | 10/1952 | MacChesney | 100/8 X |
| 2,937,484 | 5/1960 | Wiman . | |
| 3,168,912 | 2/1965 | Marica . | |
| 3,213,780 | 10/1965 | Neitzel | 100/26 X |
| 3,279,355 | 10/1966 | Missioux . | |
| 3,477,363 | 11/1969 | Trumbo . | |
| 3,767,885 | 10/1973 | Fryer . | |
| 3,863,297 | 2/1975 | Simich . | |
| 3,863,558 | 2/1975 | Trumbo . | |
| 4,055,115 | 10/1977 | Simich . | |
| 4,353,295 | 10/1982 | Kandarian | 100/8 |

FOREIGN PATENT DOCUMENTS

| | | | |
|---|---|---|---|
| 1246682 | 10/1960 | France | 100/8 |
| 872578 | 7/1961 | United Kingdom | 100/8 |

*Primary Examiner*—Billy J. Wilhite

*Attorney, Agent, or Firm*—Christie, Parker & Hale

[57] ABSTRACT

A tying device is provided for mounting on a baling press for tying a plurality of wires having preformed interlocking ends around a bale formed in the press. The device includes a center plate mounted above the press chamber in which the bale is formed and a pair of wire bend assemblies pivotally mounted on opposite sides on the center plate. A wire closer assembly is mounted on the press ram below the bale and provides the floor of the baling chamber. The wire bend assemblies pivot from a fully raised to a fully lowered position to bend the preformed interlocking ends of the wires around the bale and to insert the interlocking ends into the wire closer assembly where the interlocking ends are joined together to form a knot.

29 Claims, 17 Drawing Figures

TYING DEVICE

FIELD OF THE INVENTION

This invention relates to an apparatus and method useful for tying a plurality of wires around a bale.

BACKGROUND OF THE INVENTION

In the cotton industry, the normal method of banding or tying cotton bales has been to have workmen individually direct a tie, such as a band or wire, around a bale by hand and then secure the ends of the tie as appropriate depending on the design of the tie.

One such manual bale-tying operation is described in U.S. Pat. No. 3,477,363 to Trumbo, which is incorporated herein by this reference.

The aforementioned Trumbo patent discloses that a bale, such as a bale of cotton, can be tied using a plurality of wires that have preformed interlocking ends. In such a bale-tying operation, two workmen are normally required (one on each side of the baling press) to bend the wires and to secure the ends of the wires together in a wire tie guide assembly. The wires normally are tied together one at a time.

Since a plurality of wires are required to properly secure a cotton bale, e.g., a "universal density" cotton bale requires eight wires, a manual bale-tying process can take a substantial amount of time.

The amount of time it takes to tie a cotton bale is important since the process of pressing the next bale cannot be started until the preceding bale has been tied and removed from the press.

Therefore, an apparatus (and process) is needed in the art for tying bales, e.g., with wires such as those disclosed by Trumbo, that is designed for easy operation by one workman to reduce labor costs while at the same time can complete the bale-tying operation in less time than is required by the above-described manual process.

SUMMARY OF THE INVENTION

In accordance with this invention, a bale-tying device is provided for mounting on a bale press. The tying device can be operated by a single workman for tying a plurality of wires having first and second preformed interlocking ends around a bale formed in the press.

The tying device comprises a first wire bend assembly that is pivotally mounted on one side of the press for holding and bending the first preformed interlocking end of each wire downwardly around one side of the bale as the first assembly pivots from its fully raised to its fully lowered position. A second wire bend assembly is pivotally mounted on the opposite side of the press for holding and bending the second preformed interlocking end of each wire downwardly around the opposite side of the bale as the second assembly pivots from its fully raised to its fully lowered position. The wire-tying device additionally comprises a wire closer assembly mounted on the press beneath the bale. The wire closer assembly includes a plurality of horizontally spaced wire closers, each of which comprises an elongated open-ended cavity that extends across the width of the closer assembly.

In operation of the tying device, the first preformed interlocking end of each such wire is inserted into the first open end of one of the wire closer cavities by the first wire bend assembly as the first assembly is pivoted downwardly. The second preformed interlocking end of each such wire is inserted into the opposite open end of such a wire closer cavity by the second wire bend assembly as the second assembly is pivoted downwardly. Each wire closer additionally comprises a pocket in the cavity in which the first interlocking end of such a wire is held by the first wire bend assembly as a second interlocking end of the wire is moved by the second wire bend assembly into interlocking engagement with the first end.

DRAWINGS

These and other features, aspects, and advantages of the present invention will be more fully understood when considered with respect to the following detailed description, appended claims, and accompanying drawings, wherein:

DETAILED DESCRIPTION

Figures 1, 3:
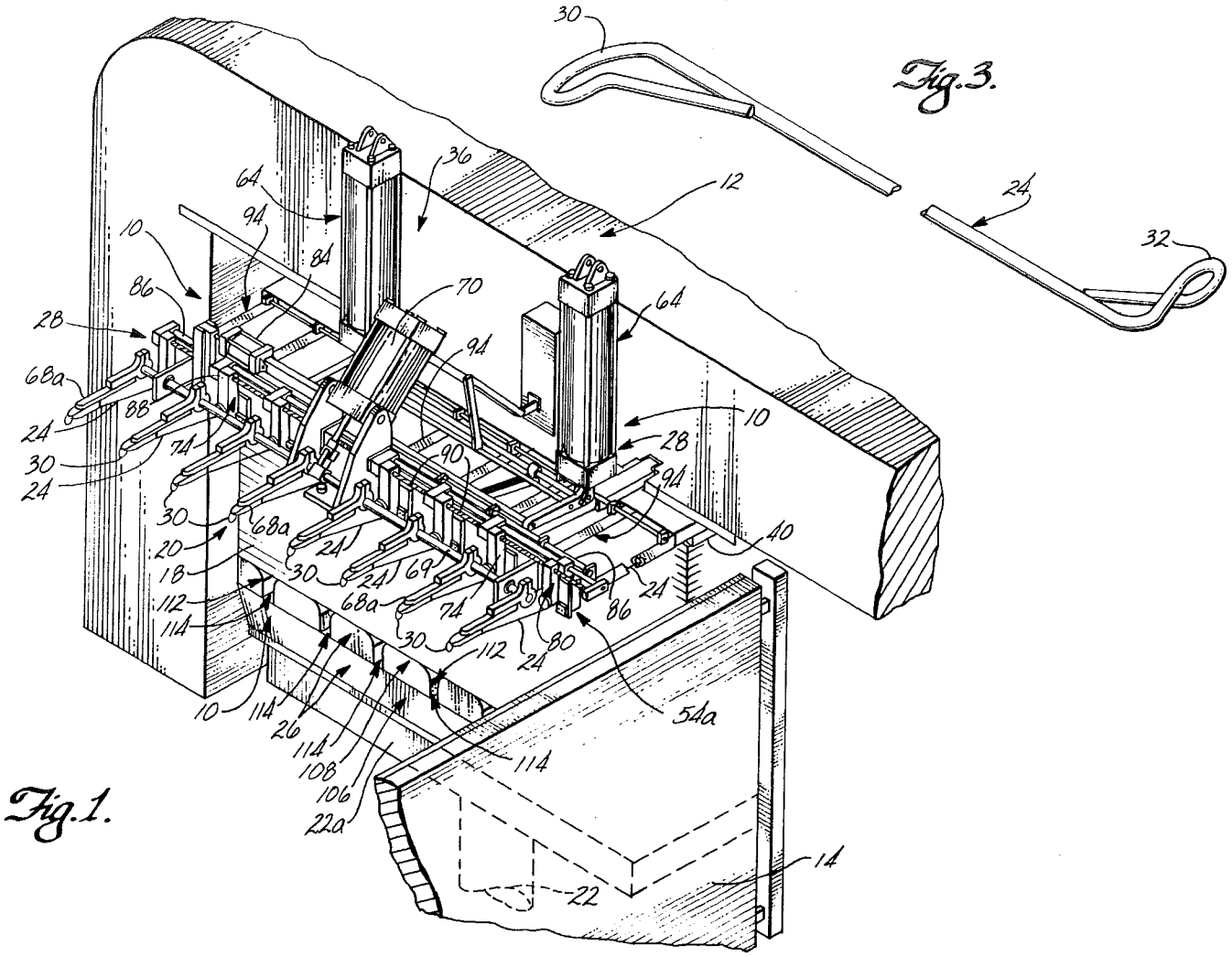
FIG. 1 is a semi-schematic perspective view of the operator side of an exemplary embodiment of a wire-tying device provided in accordance with this invention mounted on a baling press for tying a plurality of wires around a bale formed in the press.
FIG. 3 is a fragmentary perspective view of a wire having first and second interlocking ends that can be used by the tying device of this invention for tying around a bale.
Figure 2:
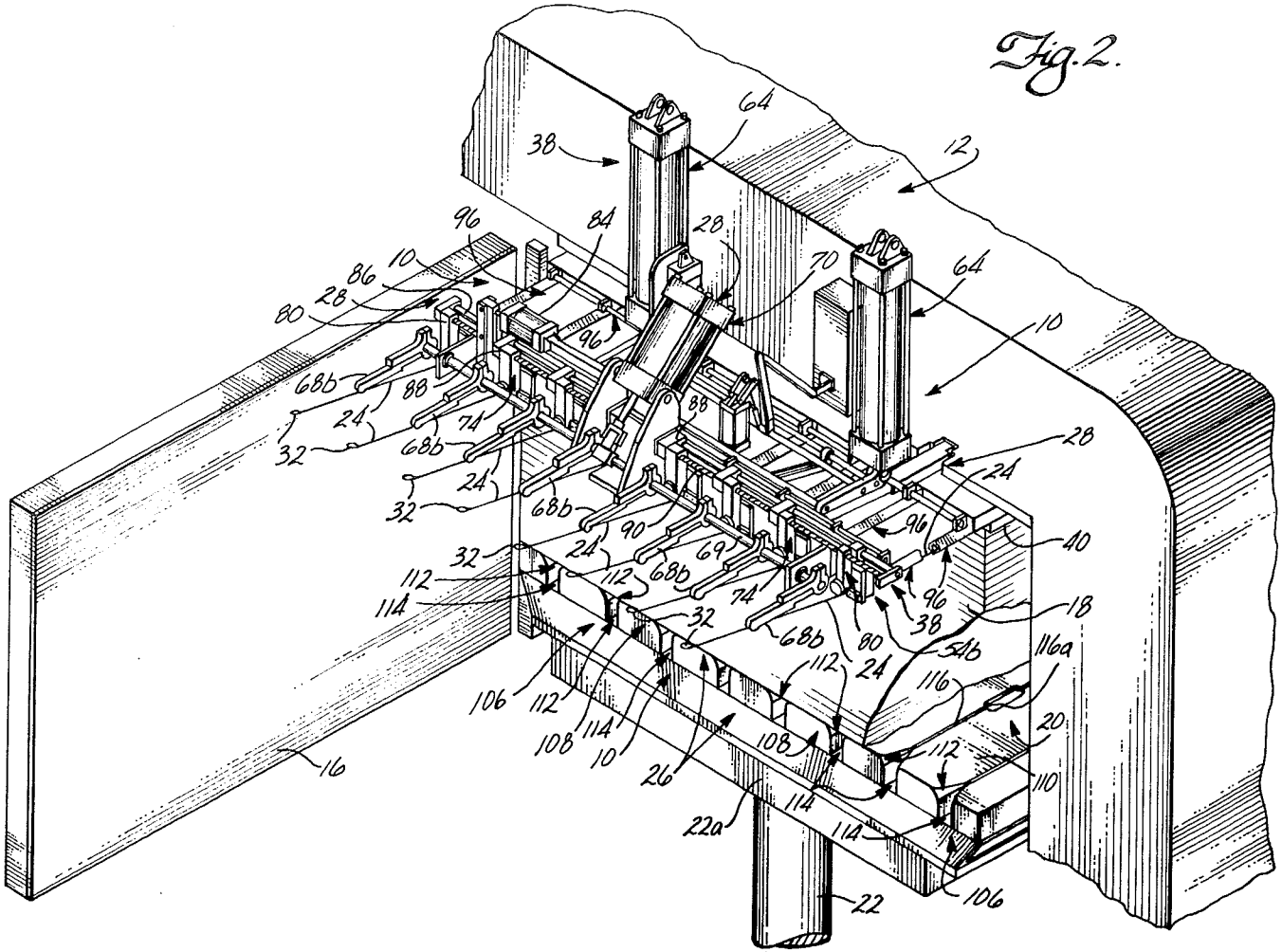
FIG. 2 is a semi-schematic perspective view of the opposite or unattended side of the tying device of FIG. 1.

Referring to FIGS. 1 and 2, there are shown semi-schematic perspective views of the front side and back side, respectively, of a working embodiment of a wire-tying device 10, provided in accordance with this invention, mounted on a typical cotton baling press 12.

The press 12 is shown with its front and back doors 14 and 16, respectively, open to provide access for tying a bale 18 compressed in the baling chamber 20 by means of a ram 22.

As is described below in greater detail, the tying device 10 (which is shown in FIGS. 1 and 2 in its fully raised position) is useful for tying eight wires 24 around a bale, such as the bale 18, after the bale has been formed in the baling chamber 20 and the press doors 14 and 16 are opened. If desired, the device 10, provided in accordance with this invention, can be modified to tie more or fewer wires than eight.

Although the tying device 10 is described with particular reference to a cotton baling operation, it can be used for tying bales of other materials as well.

A key feature of the tying device 10, provided in accordance with this invention, is that it is designed to be loaded with tie wires and operated from the front side of the press by a single workman. Since only one workman is required, and that workman need not travel back and forth from the front to the back of the press, the bale-tying operation performed by the tying device 10 is economical. For purposes of exposition herein, the front side of the tying device (shown in FIG. 1) is called the "operator side", and the back side (shown in FIG. 2) is called the "unattended side".

The tying device 10 comprises two separate assemblies which operate together to automatically tie the plurality of wires 24 around the bale 18. The first, or lower assembly is a follow block structure 26 which, as is described below in greater detail, is uniquely constructed in accordance with this invention, and which rides below the bale on the ram head 22*a*. The second, or upper assembly 28 is mounted on the baling press above the baling chamber 20 for bending the plurality of wires 24 around the bale and for inserting the opposed ends of the wires into the follow block where they are joined together.

Referring to FIG. 3, it can be understood that each of the wires 24 to be tied around the bale 18 has a first preformed interlocking end or loop 30 on the operator side of the tying device (shown in FIG. 1) and a second preformed interlocking end or loop 32 on the unattended side of the tying device (shown in FIG. 2). As is described in greater detail below, the first and second interlocking ends 30 and 32 of each of the wires 24 are automatically joined together to form a knot in the unique follow block structure by the action of the upper assembly 28 on the wires. Additional details of wires useful in practice of this invention, and the manner in which the interlocking ends of such wires engage each other to form a knot, can be found in the aforementioned U.S. Pat. No. 3,477,363 to Trumbo.

Figure 4:
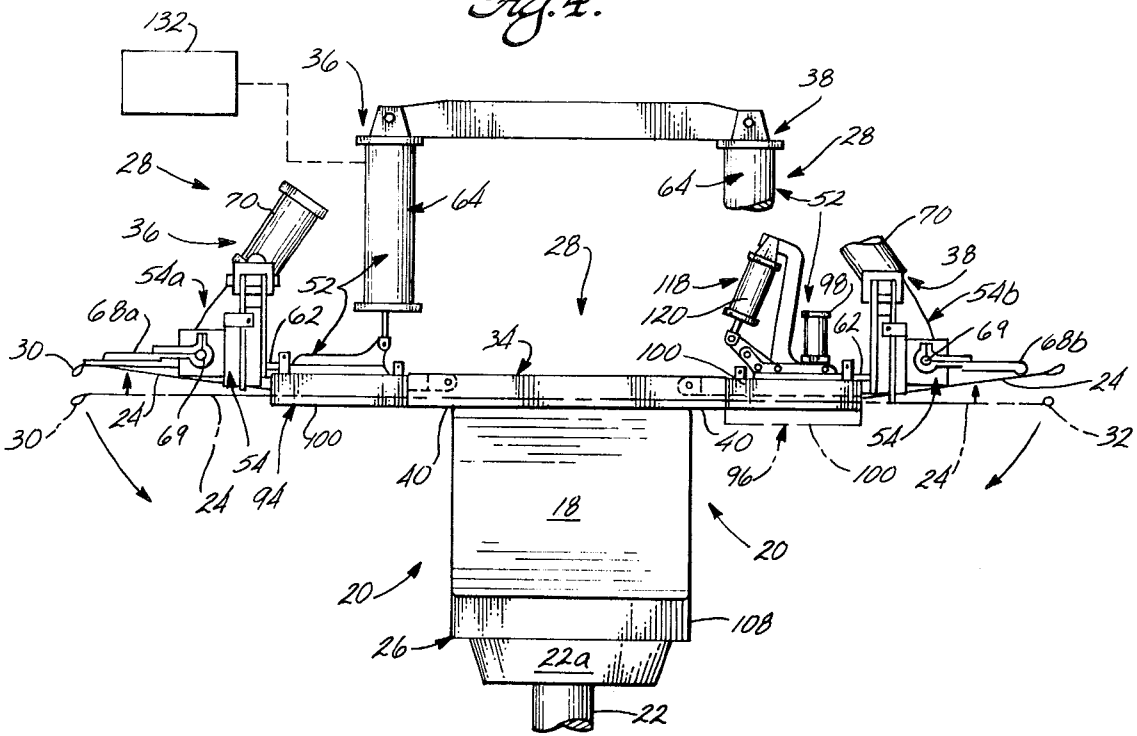
FIG. 4 is a schematic, fragmentary end view of the tying device of FIGS. 1 and 2, showing the tying device being loaded and also in its fully loaded condition.

Referring to FIG. 4, in addition to FIGS. 1 and 2, it can be understood that the tying device upper assembly 28 includes three separate structures that are operably connected together; a center plate 34 fixedly mounted on the baling press and a pair of wire bend assemblies pivotally mounted on opposite sides of the center plate for upward and downward pivoting action. The first wire bend assembly 36 is mounted on the operator side of the press (shown in FIG. 1), and the second wire bend assembly 38 is mounted on the unattended side of the press (shown in FIG. 2).

Figure 5:
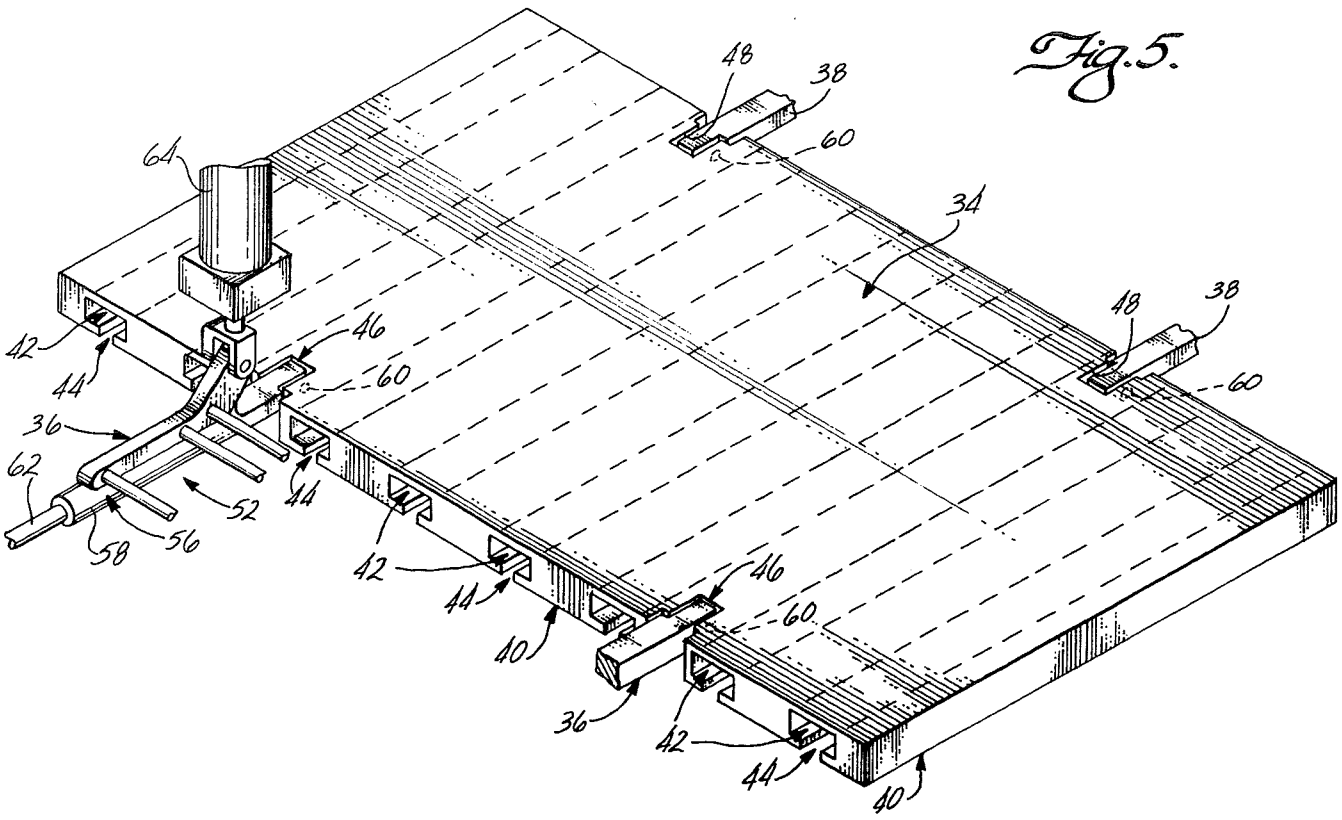
FIG. 5 is a semi-schematic perspective view of an exemplary embodiment of the center plate of the tying device of FIGS. 1 and 2.

The bottom surface 40 of the center plate 34 forms the roof of the baling chamber 20 and provides one of the surfaces against which the bale 18 is compressed. Referring to FIG. 5, it can be understood that the center plate 34 has eight elongated, slotted channels 42 formed in its bottom surface 40. The channels 42 are open-ended and extend from the front to the back side of the center plate 34 across its width. The wires 24 (not shown in FIG. 5), when loaded on the tying device 10, extend through the channels 42. The wires exit the channels through the channel slots 44 during the bale-tying operation so that the completed bale can be removed from the press.

A pair of horizontally spaced-apart recesses 46 is in the edge of the center plate 34 on the operator side of the press for pivotally mounting the first wire bend assembly 36. A pair of horizontally spaced-apart recesses 48 is in the opposite edge of the center plate for pivotally mounting the second wire bend assembly 38.

As can be best seen by referring to FIGS. 1, 2, and 4, both the first and second wire bend assemblies 36 and 38 are made up of two separate structures that are operably joined together; an inner or arm assembly 52 pivotally mounted on the center plate 34 and an outer or finger assembly 54 mounted on the arm assembly.

Figure 6:
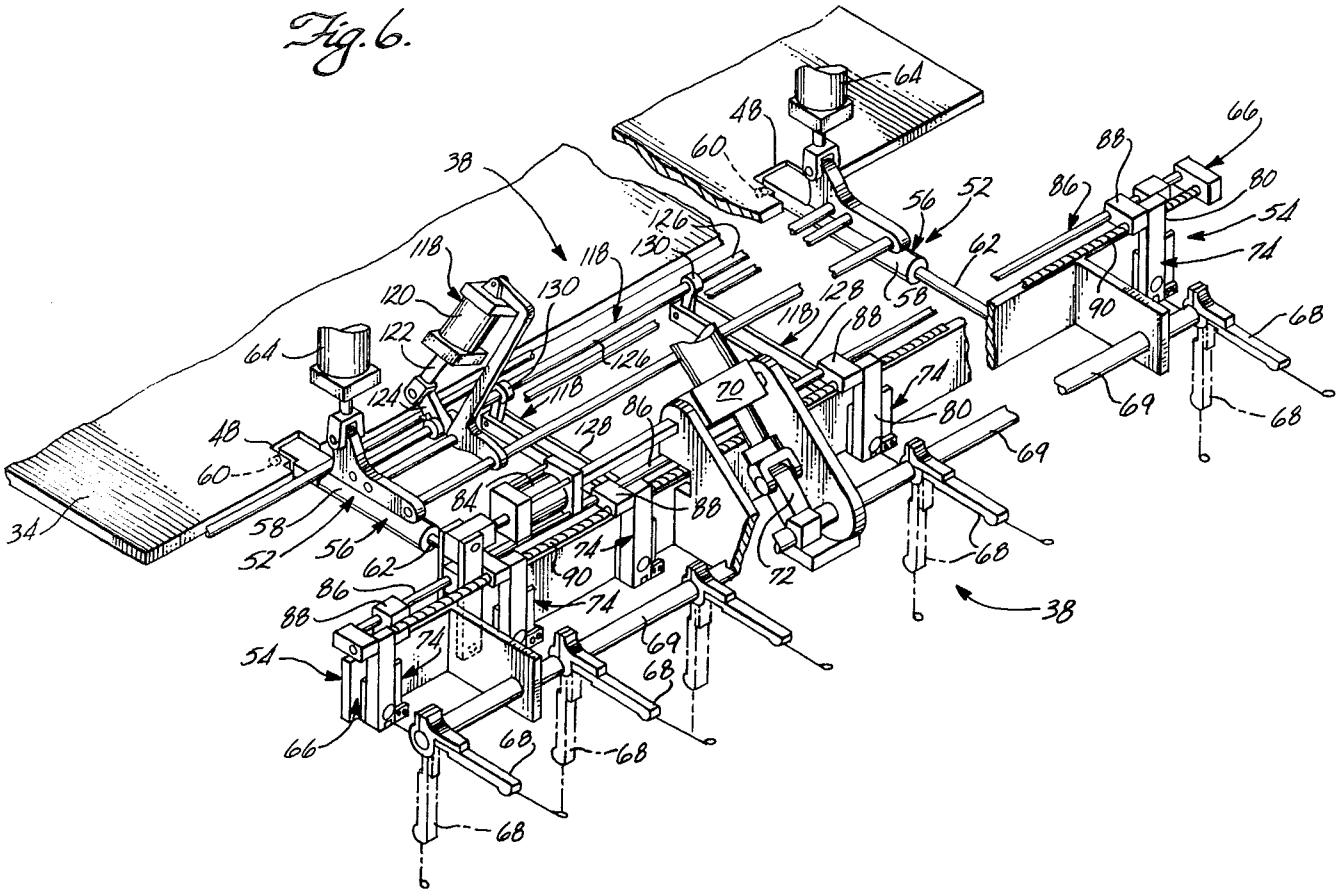
FIG. 6 is a semi-schematic, fragmentary perspective view of one of the wire bend assemblies and the center plate that comprise the tying device of FIGS. 1 and 2.

Referring to FIGS. 5 and 6, the construction of the arm assemblies 52, the connection between the arm assemblies and the center plate 34, and the connection between the arm assemblies and their associated finger assemblies, can be understood.

Each arm assembly 52 includes a pair of horizontally spaced-apart cylinder arms 56 connected between the center plate 34 and its associated finger assembly. Each cylinder arm 56 includes a cylinder 58 pivotally mounted at one end by means of a horizontal pivot 60 mounted in each center plate recess 46 (shown in FIG. 5 for the first wire bend assembly 36), and in each center plate recess 48 (shown in FIGS. 5 and 6 for the second wire bend assembly 38). Extending from the opposite end of each such cylinder 58 is a rod 62 which is capable of being moved into and out of the cylinder. The end of each of the rods 62 is fixedly connected to its respective finger assembly 54.

The above-described arm assembly construction provides each finger assembly with the capability of being moved toward and away from its respective arm assembly. As is described below in greater detail, moving either one or both of the finger assemblies away from their respective arm assemblies during the wire-tying operation takes the slack out of that portion of each of the wires that extends between the finger assemblies so that the wires can be stretched tightly across the top of the bale.

A pneumatic cylinder 64 is connected to each arm 56 to provide for pivoting the arm assemblies 52, and thus the wire bend assemblies 36 and 38, down from their fully raised positions (as shown in FIGS. 1 and 2) to their fully lowered positions.

Figure 7:
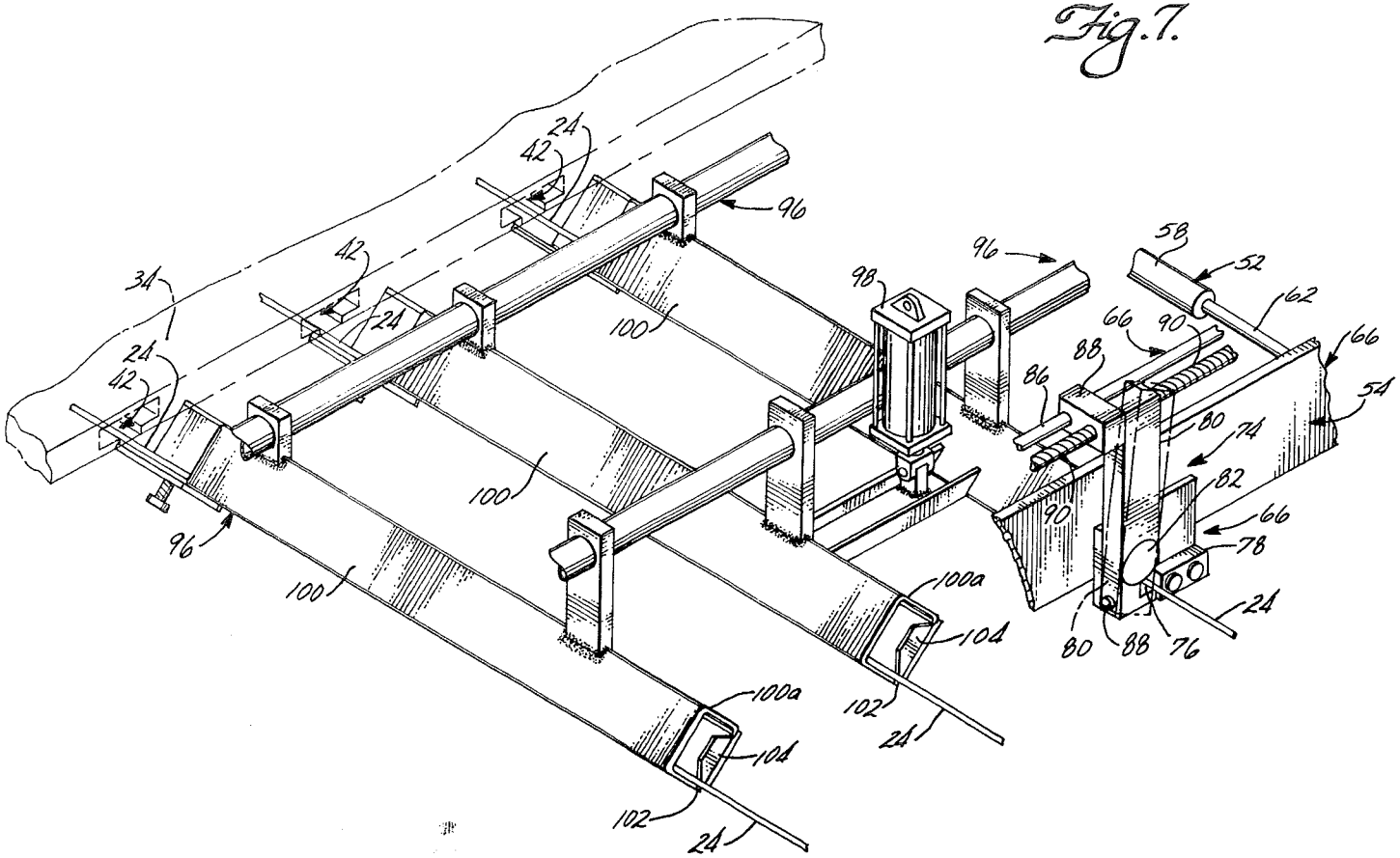
FIG. 7 is a semi-schematic, fragmentary perspective view showing details of a guide tube assembly and a gripper assembly that comprise one of the wire bend assemblies of the tying device of FIGS. 1 and 2.

Referring particularly to FIGS. 6 and 7, it can be understood that each finger assembly 54 comprises a gripper structure 66 connected to each of the arm assemblies 52 by means of the cylinder rods 62. In addition to the gripper structure 66, each such finger assembly 54 includes eight elongated fingers 68 (only five of which are shown in FIG. 6, while all eight are shown in FIGS. 1 and 2) horizontally spaced-apart from each other on a rotatably mounted horizontal rod 69 (best seen in FIG. 6 and FIGS. 1 and 2). A pneumatic cylinder 70 is provided on each finger assembly and is connected to the rod 69 by means of a crank 72 (best seen in FIG. 6). As is described in greater detail below, when the pneumatic cylinder 70 is operated, the fingers 68 are pivoted downwardly from their fully raised position extending generally horizontally away from the press (shown in solid lines in FIG. 6 and in FIGS. 1 and 2), to their fully lowered position (shown in dashed lines in FIG. 6).

Referring to FIGS. 1, 2, and 4, it can be seen that the operator side finger assembly **54*a* includes eight fingers 68*a*, and the unattended side finger assembly 54*b* includes eight fingers 68*b*. Each of the fingers 68*a* on the finger assembly 54*a* is directly across from a counterpart finger 68*b* on the finger assembly 54*b*. As is described in greater detail below, each finger 68*a* and its counterpart finger 68*b***, i.e., each pair of fingers, operates on the opposed ends of a single wire during the tying operation.

Details of the construction and operation of the gripper structure 66 on both the first and second wire bend assemblies 36 and 38, respectively, can be understood by referring to FIGS. 1, 2, 6, and 7. Each gripper structure comprises eight identical anvil assemblies 74 horizontally spaced apart from each other. One such anvil assembly 74 is associated with one of the fingers 68 and holds one end of each wire 24 firmly therein during the wire-bending operation. As is best seen in FIG. 7, each anvil assembly 74 comprises an anvil 76, an anvil block 78, and an anvil arm 80. Each anvil arm 80 is pivotally mounted on the gripper structure by means of a pivot 82 so that each such arm can be pivoted toward and away from its associated anvil block 78. A pneumatic cylinder 84 (shown in FIGS. 1, 2, and 6) is mounted on the gripper structure 66 of both finger assemblies for providing the pivoting motion to each of the pivot arms 80. The pneumatic cylinder 84 is operably connected to a rod 86 that extends horizontally along the length of the gripper structure. Fixedly connected to the rod 86 in horizontally spaced-apart relationship are eight pivot blocks 88, each of which bears against the top of one of the anvil arms 80. Extending between the top of each anvil arm 80 and the adjacent pivot block 88 which does not act on that particular anvil arm, is a spring assembly 90.

When the pneumatic cylinders 84 on both the front side and back side gripper structures 66 are operated to open the anvil assemblies, i.e., when the cylinders 84 are operated to pivot the bottom portion of each anvil arm away from its respective anvil block, they move both the associated rods 86 and the spring assemblies 90 horizontally to the right, as viewed in FIGS. 6 and 7. Such movement of the rods 86 pushes the pivot blocks 88 against the tops of the anvil arms to thereby pivot the bottoms of the anvil arms away from their associated anvil blocks 78 to open the anvil assemblies. (The anvil arm is shown pivoted to its open position in dashed lines in FIG. 7.)

When it is desired to close the anvil assemblies 74, the pneumatic cylinders 84 are operated to move the rods 86 and the spring assemblies 90 horizontally to the left, as is shown in FIGS. 6 and 7. Such movement of the rods 86 pulls the pivot blocks 88 away from the tops of the anvil arms, thereby allowing the spring assemblies to pivot the bottoms of the anvil arms toward the anvil blocks 78 to close the anvil assemblies. (The anvil arm is shown in its closed position in solid lines in FIG. 7.) The spring assemblies 90 provide sufficient force to hold the anvil assemblies closed so that the wires 24, positioned within the anvil assemblies, are held firmly in place between the end of an adjustable screw 88 (shown in FIG. 7), which extends horizontally through the bottom of each anvil arm and the associated anvil block 78. Since each anvil arm is independently held closed by its associated spring assembly 90, wires that have different diameters, e.g., due to wire manufacturing tolerances, can be accommodated at the same time on the tying device 10 of this invention. If the anvil arms were solidly mounted on the rods 86, for example, only the wire with the largest diameter would be held firmly in the closed anvil assembly, while wires of smaller diameter would be loose.

Means are provided on both the first and second wire bend assemblies 36 and 38, respectively, for guiding the wires 24 into proper position on the tying device 10 during the wire-loading operation. The wire guide means comprises a first guide tube assembly 94 on the first wire bend assembly 36 (shown in FIG. 1) and a second wire guide assembly 96 on the second wire bend assembly 38 (shown in FIG. 2).

Referring to FIG. 7, there is shown a portion of the second guide tube assembly 96, which is identical to the first guide tube assembly 94 with the exception that the assembly 96 includes a pneumatic lift cylinder 98 for lifting the second guide tube assembly while the first guide tube assembly does not include such a cylinder. As is described below in greater detail, the lift cylinder 98 enables the wires to be loaded into the wire-tying device and engaged in the gripper structure anvil assemblies on the unattended side of the press without a workman having to be present on that side.

The construction of both the guide tube assembly 94 on the operator side of the press and the guide tube assembly 96 on the unattended side of the press can be understood by referring to FIG. 7. Each of the guide tube asemblies 94 and 96 comprises eight interconnected, horizontally spaced-apart, hollow guide tubes 100 (only three of which are shown in FIG. 7), wherein each such guide tube is open at both ends. Each guide tube 100 is associated with one of the fingers 68 on its respective wire bend assembly. Additionally, each guide tube 100 is aligned in a direction about parallel to its associated finger 68 when the finger is in its fully raised position. A slot 102 is through the bottom of each guide tube along its length so that the wires 24 inserted through the guide tubes can exit the tubes during the tying operation. A spring-mounted flap 104 is on the distal end **100*a* of each such tube extending across the slot 102 in the bottom of the tube. The flaps 104 maintain the wires 24** in the tubes during the wire-loading operation and during a first portion of the wire-tying operation. The flaps are forced open by the wires to allow them to exit the guide tubes after the wires are around the bale.

Additional details of construction of the guide tubes and their operation is described in greater detail below with regard to the operation of the wire-tying device.

Figure 8:
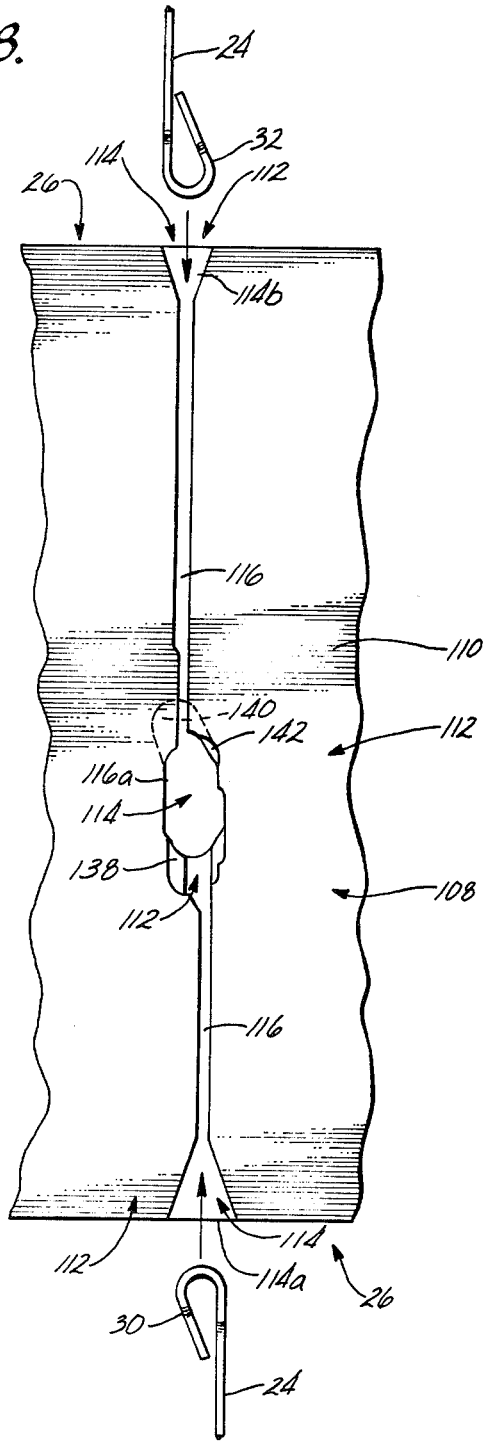
FIG. 8 is an enlarged fragmentary top view of one of the wire closers that comprise the wire closer assembly of the tying device of FIGS. 1 and 2.

Referring to FIGS. 1, 2, and 8, the follow block structure 26 comprises a base 106 and a wire closer assembly 108 mounted on the base. The top surface 110 of the wire closer assembly 108 forms the floor of the baling chamber 20 in which the bale 18 is formed. The bale 18 is carried on the wire closer and is compressed against the surface 110 when the press ram 22 is raised. The closer assembly 108 comprises a plurality of horizontally spaced-apart, identical wire closer structures or closers 112. In this instance, since the wire-tying device 10 of the illustrated embodiment is designed to tie eight wires 24 around the bale 18, eight wire closers 112 make up the closer assembly 108 (only one such wire closer is shown in FIG. 8). Each wire closer 112 includes a cavity 114 open at both ends for insertion of the opposed preformed interlocking ends 30 and 32 of one of the wires as such a wire is bent around the bale by the operation of the wire bend assemblies 36 and 38. For example, as best seen in FIG. 8, the first preformed end 30 of each wire 24 is inserted into the open end 114*a* of the wire closer cavity 114, and the second preformed end 32 of each wire 24 is inserted into the opposite open end 114*b* of the cavity 114. Means described below in greater detail are provided in each wire closer cavity for joining the preformed interlocking ends of the wires together as such opposed ends are inserted into the cavity and moved into engagement with each other.

A slot 116 (best seen in FIGS. 2 and 8) extends horizontally across the top surface 110 of each wire closer 112 and opens into its cavity 114. The slots 116 are provided for removal of the wires 24 after the wires are tied around the bale. An enlarged area 116*a* of each slot 116 is provided for removal of the knot formed by the interlocking ends of the wires after they are joined together.

Additional details of construction of the wire closers 112 are described below in relation to the operation of the wire-tying device 10.

Referring again to FIG. 6, a wire stretch assembly 118 is mounted on the arm assembly 52 of the second bend assembly 38 to move the finger assembly 54 toward and away from its associated arm assembly 52. Movement of the finger assembly 54 away from the arm assembly 52 stretches that portion of each wire 24 that extends between the gripper structures 66 on the first and second wire bend assemblies when the wires are on the device and secured in the closed anvil assemblies. Although only one wire stretch assembly 118 is provided in the illustrated embodiment, and it is on the second bend assembly 38, a second wire stretch assembly can be provided on the first wire bend assembly 36, if desired. Alternatively, when only one stretch assembly is provided, it can be mounted on the first wire bend assembly 36, instead of the second assembly 38.

The wire stretch assembly 118 includes a pneumatic cylinder 120 that is connected by means of a cylinder rod 122 and associated linkage 124 to a horizontally extending torque tube or rod 126. Operation of the cylinder 120 results in rotation of the torque bar. A pair of stretch arms 128 is provided, with each such arm attached on one end by appropriate linkage 130 to the torque tube 126 and on the other end to the finger assembly 54. When the pneumatic cylinder is operated to move the cylinder rod 122 out of the cylinder, the torque tube is rotated in a first direction to push the arms 128 away from the center plate. This action moves the finger assembly 54 away from the arm assembly 52 and thus, away from the center plate 34. As the finger assembly moves away from the center plate 34, the rods 62, comprising each of the cylinder arms 56, are moved out of their respective cylinders 58. Such movement of the finger assembly 54 away from the center plate results in the gripper structure 66 of the second wire bend assembly 38 being moved away from the gripper structure 66 of the first wire bend assembly 36. Thus, as is described below in greater detail, during the wire-tying operation, when the wires are being bent around the bale and are held firmly in the closed anvil assemblies, operation of the stretch assembly 118 takes the slack out of that portion of each of the wires that extends between the gripper assemblies. This stretches the wire tightly across the top of the bale 18 and provides for proper positioning of the opposed ends of the wires in the wire closers.

The operation of the stretch assembly 118 can be adjusted to provide a desired amount of stretch to the wires. In a working embodiment, the stretch assembly 118 can be adjusted to move the gripper assemblies apart from between about $1\frac{1}{2}$ to about $3\frac{1}{2}$ inches. If desired, less than $1\frac{1}{2}$ inches or more than $3\frac{1}{2}$ inches of stretch can be provided.

LOADING AND AUTOMATIC TYING OPERATION

Loading of the wires 24 onto the wire-tying device 10, and the operation of the device for automatically tying the wires around the bale 18, can be understood by referring particularly to FIGS. 4 and 9–17.

Referring first to FIG. 4, a control circuit that is shown schematically at 132 is provided to control the tying device 10 during manual loading and automatic tying. The control panel of the control circuit 132 is mounted on the operator side of the press.

During the time that the bale 18 is being formed in the baling chamber 20 and the press doors 14 and 16 are closed, the wires 24 are loaded or positioned on the device 10 for tying by a single workman stationed on the operator side of the press (shown in FIG. 1). To load each such wire 24 onto the device 10, the workman pushes the second preformed end 32 of the wire through one of the guide tubes 100 on the first guide tube assembly 94, through the associated cavity 42 in the center plate 34, and thence through the associated guide tube 100 (shown in its lower position in dashed lines in FIG. 4) on the second wire guide assembly 96. This procedure is repeated for loading all eight wires 24 onto the device. At this time, the first preformed end 30 of each wire 24 (as shown in dashed lines in FIG. 4) extends out from the guide tube 100 of the first wire guide assembly 94 to a position below its associated operator side finger 68*a* and below the now open anvil assembly in which it is to be held. In similar fashion, the second preformed end 32 of each wire 24 (as shown in dashed lines in FIG. 4) extends from the guide tube 100 of the second guide tube assembly 96 to a position below its associated finger 68*b*.

Figure 15:
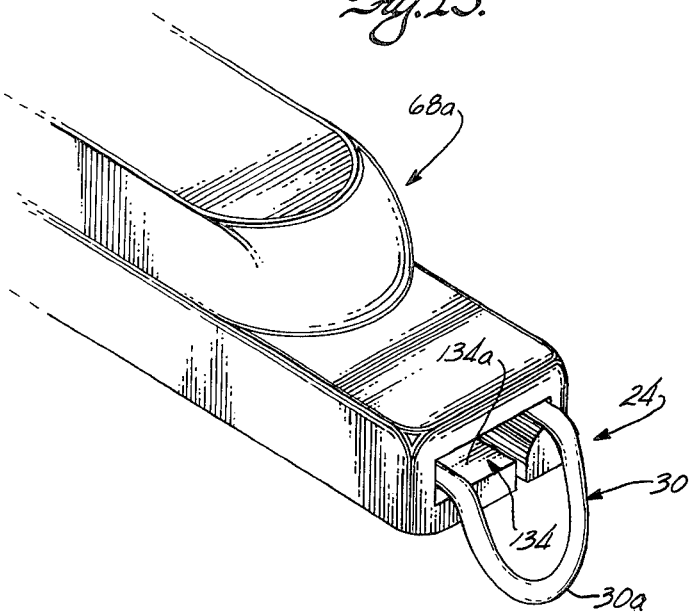
FIG. 15 is an enlarged, semi-schematic, fragmentary perspective view of one of the fingers on the operator side of the wire-tying device with a wire engaged in the finger.
Figure 16:
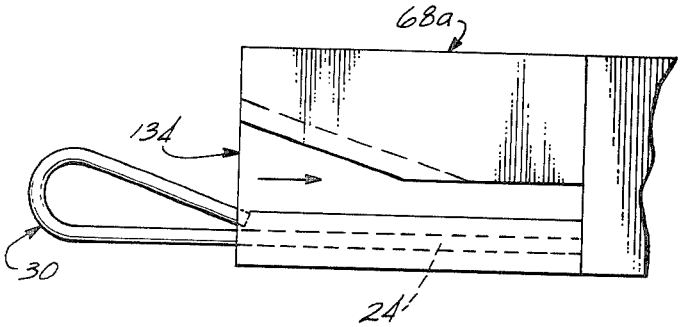
FIG. 16 is a semi-schematic bottom view of the finger of FIG. 15.

Referring to FIGS. 15 and 16, in addition to FIG. 4, the operator places the first ends 30 of each of the wires 24 in a recess 134 in the end of each of the fingers 68*a*. The recess 134 in each such finger 68*a* holds the wire 24 in proper position against rotation so that it is positioned properly with its tip 30*a* pointing down. The recess 134 has an opening 134*a* on its distal end, i.e., the opening 134*a* is on the end of the finger 68*a*. The opening 134*a* is provided so that the preformed end 30 of each wire 24 can slide out of the end of the finger as the wire is bent during the tying operation. As is described below in greater detail, the ends 30 of the wire must extend a sufficient distance from the distal ends of the fingers 68*a* so that the wires can be properly positioned and joined together in the wire closers 112. Since the wires 24 are placed in proper position by inserting their ends 30 in the recesses 134, no such recesses are required, and none are provided, on the fingers 68*b* of the bend assembly 38 on the unattended side of the press.

By the operation of placing the ends 30 of the wires 24 in the recesses 134, the wires are moved up (as shown in solid lines in FIG. 4) and held in position in the open anvil assemblies on the operator side of the press.

To position the opposite ends of the wires 24 in the open anvil assemblies on the unattended side of the press the workman pushes a button on the control circuit panel to thereby operate the pneumatic cylinder 98 on the second guide tube assembly 96. Such remote operation of the cylinder 98 lifts the guide tubes 100 of the second guide tube assembly 96 from a first relatively lower position (shown in dashed lines in FIG. 4) to a second relatively higher position (shown in solid lines in FIG. 4). When the guide tubes are in their lower position, the wires 24 (shown in dashed lines in FIG. 4) extend from the ends of the tubes 100 beneath their respective anvil assemblies and associated fingers 68*b*. When the guide tubes are moved to their raised position by the operation of the cylinder 98, they lift the wires 24 (shown in solid lines in FIG. 4) into the open anvil assemblies on the finger assembly 54*b*.

About one second after the button is pushed to raise the second guide tube assembly 96 and thus, after all of the wires 24 are properly positioned in the open anvil assemblies, the control circuit automatically operates the pneumatic gripper structure cylinders 84 on both the first and second wire bend assemblies 36 and 38. Operation of the cylinders 84 closes the anvil assemblies in the manner described above so that the wires are now held securely in place for tying.

After the above-described manual and semi-automatic wire loading operations have been completed and the wires are secured in the anvil assemblies, the tying device 10 is said to be in its "fully loaded" condition. As is desribed below in greater detail, once the tying device is in its fully loaded condition, the remainder of the bale-tying operation is controlled automatically by the operation of the control circuit 132.

After the device 10 is loaded, and when the press ram 22 reaches its fully raised position (as shown in FIG. 4), the press doors are opened (as shown in FIGS. 1 and 2) so that the bale 18 is exposed in the baling chamber 20 for tying. The press doors, when fully open, operate a limit switch in the control circuit 132, which in turn starts the automatic sequencing of the bale-tying operation.

Figure 9:
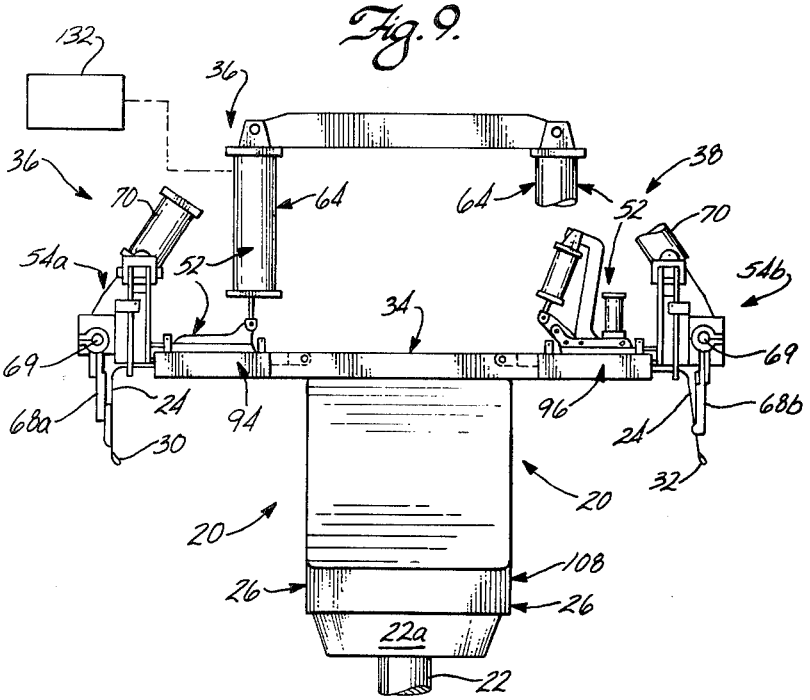
FIG. 9 is a schematic, fragmentary end view of the tying device, similar to the view shown in FIG. 4, at a first stage in the wire-tying operation with the wire bend assembly fingers in their fully lowered position.

Referring to FIG. 9, the control circuit 132 automatically initiates the tying sequence by first operating the pneumatic cylinders 70 on both the first and second wire bend assemblies 36 and 38 to thereby rotate the rods 69 associated with the finger assemblies 54*a* and 54*b* about 90°. Rotation of the rods 69 pivots the fingers 68*a* on the first finger assembly 54*a* and the fingers 68*b* on the second finger assembly 54*b* from their fully raised position (as shown in FIG. 4) to their fully lowered position (as shown in FIG. 9). Such pivoting movement of the fingers bends the ends of each of the wires 24 about 90° around the anvils 76 of the closed anvil assemblies in which they are held.

Since the pivot point of the fingers, i.e., since the rods 69 are closer to the ends of each of the wires 24 than are the anvils around which the wires are bent, the first preformed ends 30 of the wires slide out of the recesses 134 in the fingers 68*a* as the wires are bent by the fingers. In a working embodiment of the wire-tying device 10, the first preformed ends 30 of each of the wires 24 extend about 4 ½ inches out of the recesses 134 of the fingers 68*a* after the 90° bend is made. The second preformed ends 32 of the wires 24 also slide away from the tips of the fingers 68*b*. Therefore, after the fingers have been pivoted from their fully raised to their fully lowered positions, the ends 30 and 32 are a desired distance from their associated fingers so that they may be properly positioned in the wire closers.

Figure 10:
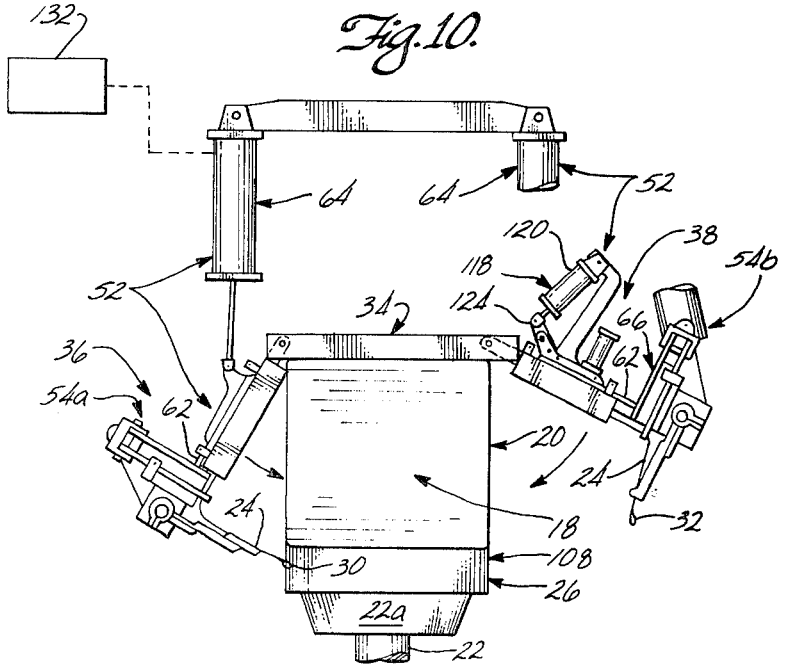
FIG. 10 is a schematic, fragmentary end view of the tying device of FIG. 9 at a second stage in the wire-tying operation after both the front and back side arm assemblies have started pivoting from their fully raised to their fully lowered positions.

Referring next to FIG. 10, after a time delay of sufficient length to allow the fingers to arrive at their fully lowered positions, the control circuit automatically operates the pneumatic cylinders 64 on the first wire bend assembly 36 to start the first assembly pivoting downwardly from its fully raised to its fully lowered position. The first wire bend assembly operates to bend the first preformed ends 30 of the wires 24 downwardly around the operator side of the bale 18. After an additional time delay, the control circuit automatically operates the pneumatic cylinders 64 on the second wire bend assembly 38 to start the second wire bend assembly pivoting downwardly from its fully raised to its fully lowered position. The second wire bend assembly operates to bend the second preformed ends 32 of the wires 24 downwardly around the opposite side of the bale.

The time delay between the start of pivoting the first wire bend assembly 36 and the start of pivoting the second wire bend assembly 38 is sufficient to provide that the first assembly is in its fully lowered position holding the first preformed ends 30 of the wires 24 in position in the wire closers, while the second wire bend assembly continues its pivot toward its fully lowered position. Thus, the second wire bend assembly moves the second preformed ends 32 of the wires into their respective wire closers only after the first preformed ends have been properly positioned in the closers for engagement with the second ends.

A time delay is provided in the control circuit to automatically operate the pneumatic stretch cylinder 120 of the wire stretch assembly 118 after the first and second wire bend assemblies begin pivoting down. As is described above, operation of the stretch cylinder 118 through the linkage 124 rotates the torque tube 126 (not shown on FIG. 10) to thereby move the gripper structure 66 on the second wire bend assembly 38 away from the center plate 34 to thereby take up the slack in that portion of the wires that extends between the gripper asemblies. The wire bend assembly 38 is shown in FIG. 10 after the wire stretch assembly 118 has operated to stretch the wires tightly across the top of the bale.

As can be seen by referring to FIG. 10, the wire bend assemblies continue their downward pivot so that the first interlocking ends 30 of the wires 24 are placed into proper position in the wire closer assembly 108, first followed by insertion into the closer assembly of the second interlocking ends 32 of the wires.

So that the interlocking ends of the wires 24 are free to move into proper position in the closers, the control circuit automatically operates (by means of limit switches associated with both the first and second wire bend assemblies) to release the pressure on the finger bend cylinders 70 just before the ends of the wires enter the closers. Releasing the pressure on the finger bend cylinders allows the fingers to "float", i.e., allows the fingers to move freely so that the fingers can enter the closers without jamming and to ensure that proper positioning of the wires in the closers is not inhibited by the fingers.

The sequence of insertion of the interlocking ends of the wires into the wire closers, the manner in which the wires are joined together in the closers, and additional details of construction of the closers can be best understood by referring to FIGS. 8 and 11–16.

Figure 11:
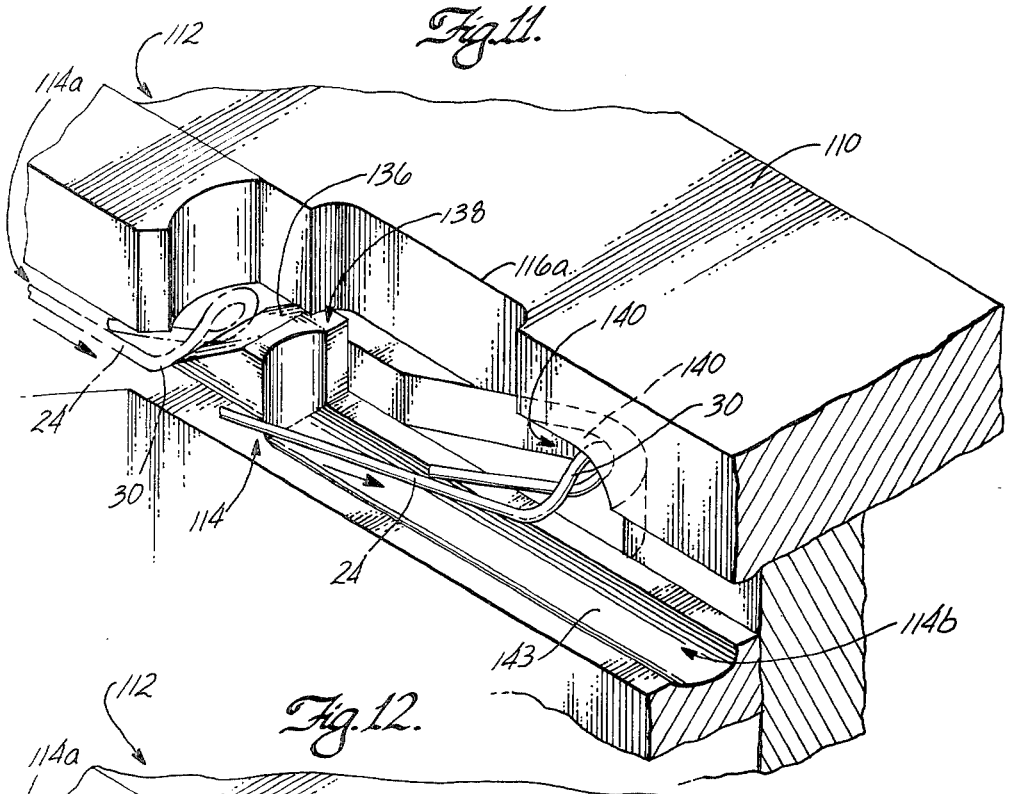
FIG. 11 is a semi-schematic, enlarged perspective, fragmentary view of one of the wire closers of the wire-tying device of FIGS. 1 and 2 showing an early stage of the sequence of joining the preformed interlocking ends of one of the wires together in the closer.

Referring first to FIGS. 8 and 11, due to the above-described preprogrammed automatic sequencing of the arm assemblies, the first interlocking end or loop 30 of each wire 24 enters the end 114*a* of the cavity 114 of its respective closer 112 before the second interlocking end 32 (not shown in FIG. 11) enters the end 114*b*. The loop 30 of the wire 24 (shown in phantom lines in FIG. 11) is pushed up a wire closer ramp 136 in the cavity 114 as the first bend assembly 36 continues to pivot towards its fully lowered position. The loop 30 then snaps over a stop 138 in the cavity 114 and is guided into a pocket 140 by a curved guide 142 (shown in FIG. 8) against which the loop slides as it is pushed forward into the closer cavity. The loop 30 of each such wire 24 is held securely against movement in and out of the pockets 140 by the first wire bend assembly 36 when it is in its fully lowered position. The loops 30 are prevented from moving up or down by the top and bottom surfaces of the pocket. When the loops 30 of the wires (as shown in solid lines in FIG. 11) are in position in the pockets 140, the loops are ready to be engaged and joined together with the second interlocking ends or loops 32.

Figure 12:
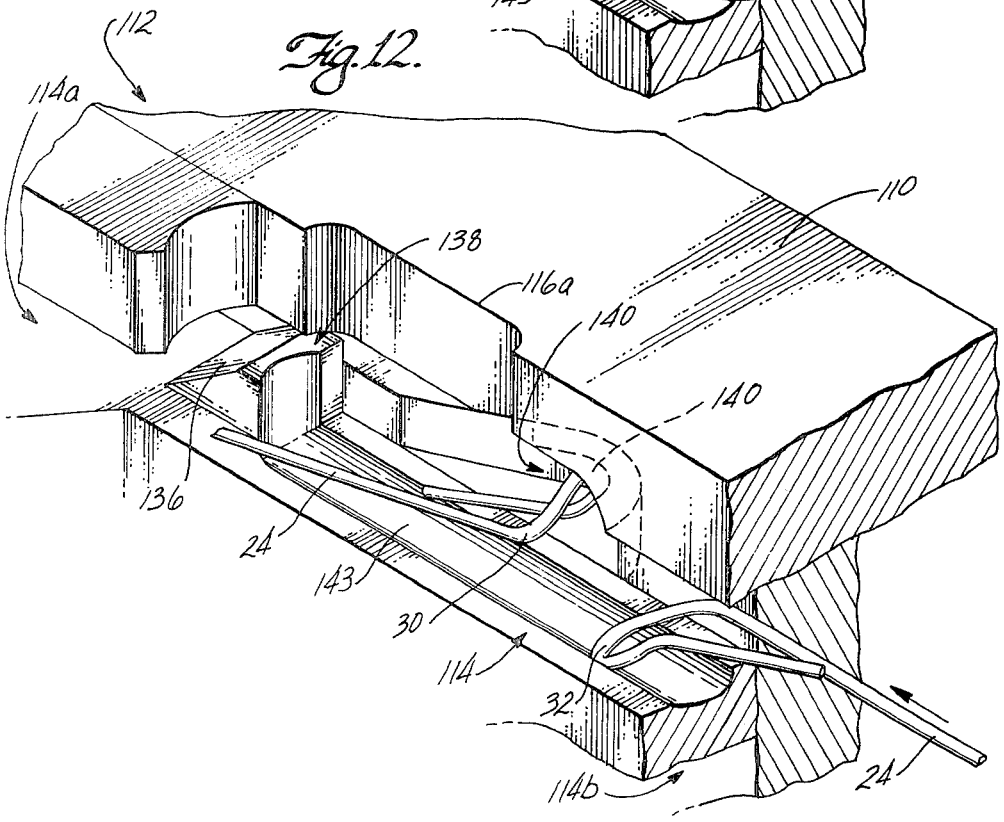
FIG. 12 is a semi-schematic, enlarged perspective, fragmentary view of the wire closer of FIG. 11 showing a later stage of the sequence of joining the preformed interlocking ends of one of the wires together in the closer.

Referring next to FIG. 12, the loop 30 of the wire 24 is positioned in the pocket 140, as described above with reference to FIG. 11, while the second end or loop 32 of the wire 24 enters the end 114*b* of the wire closer cavity 114 and is pushed into the cavity 114 by the second bend assembly 38 as it moves toward its fully lowered position. The loop 32 moves toward the loop 30 in a groove 143 in the bottom surface of the closer cavity 114. The loop 32 is biased into the groove 143 so that it remains in proper alignment for mating with the loop 30 in the pocket 140. The loop 32 is biased into the groove 143 because of the tendency of the wire to "spring back" from the 90° bend made by the fingers to about a 60° bend after the control circuit has operated to "float" the fingers.

Figure 13:
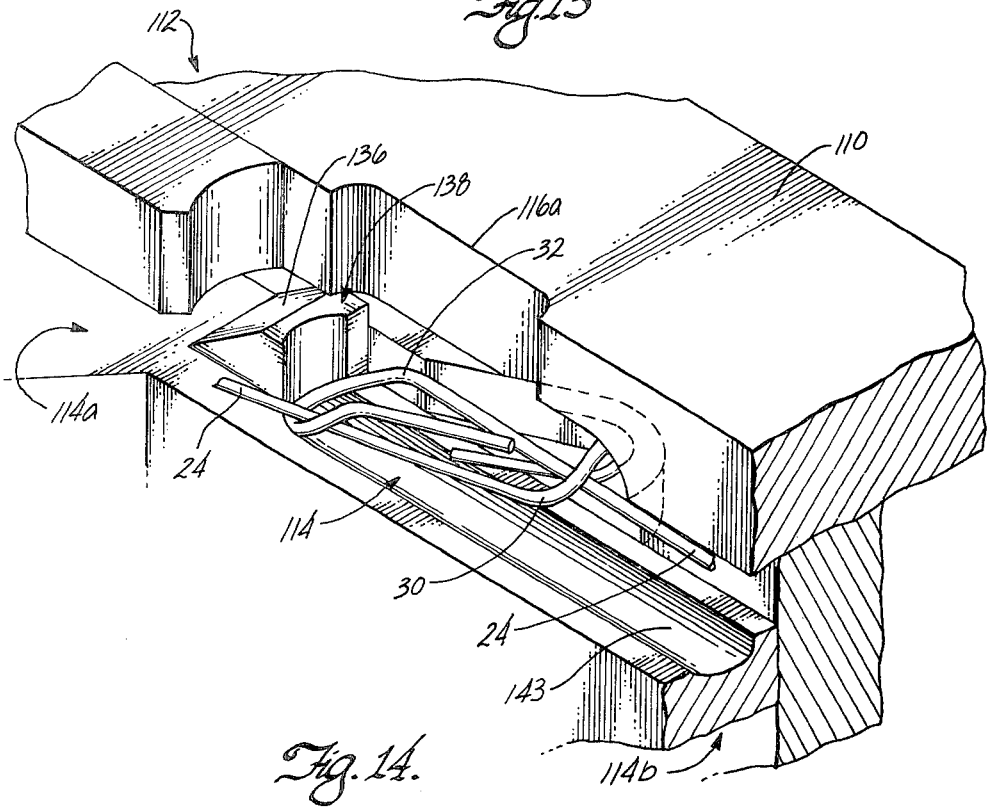
FIG. 13 is a semi-schematic, enlarged perspective, fragmentary view of the wire closer of FIG. 12 showing a later stage of the sequence of joining the preformed interlocking ends of one of the wires together in the closer.
Figure 14:
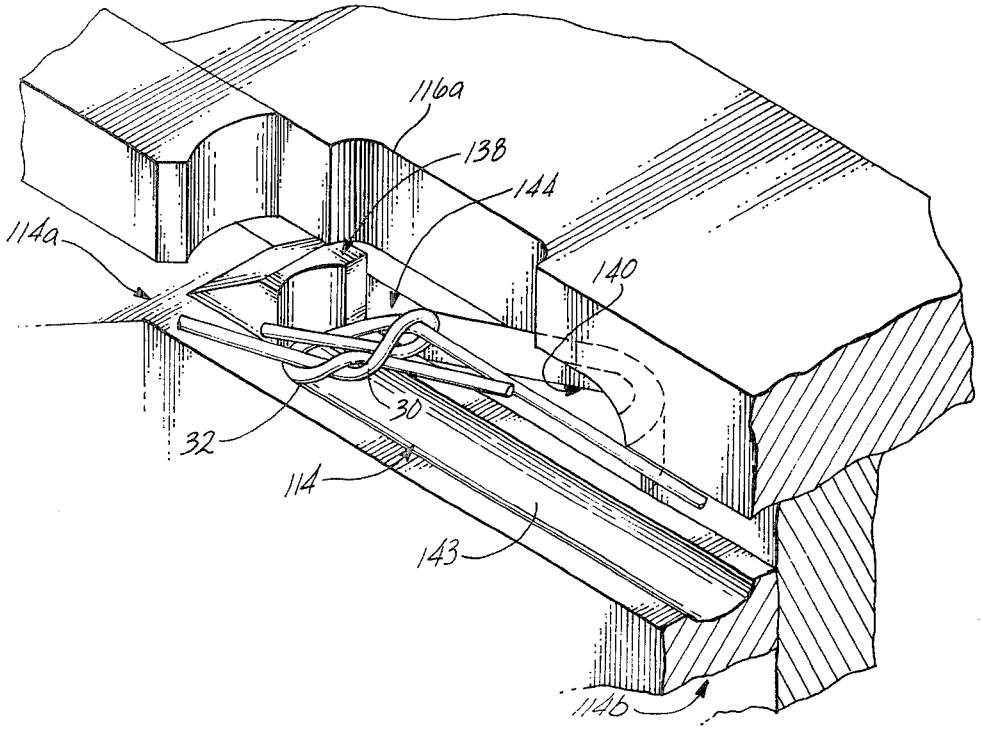
FIG. 14 is a semi-schematic, enlarged perspective, fragmentary view of the wire closer of FIG. 13 showing a later stage of the sequence of joining the preformed interlocking ends of one of the wires together in the closer.

Referring next to FIG. 13, the loop 32 of the wire 24 is shown engaged with the loop 30 after the loop 32 has been pushed past the loop 30 by the second arm assembly 38. When the second arm assembly 38 is in its fully lowered position, the loop 32 is adjacent the stop 138.

Figure 17:
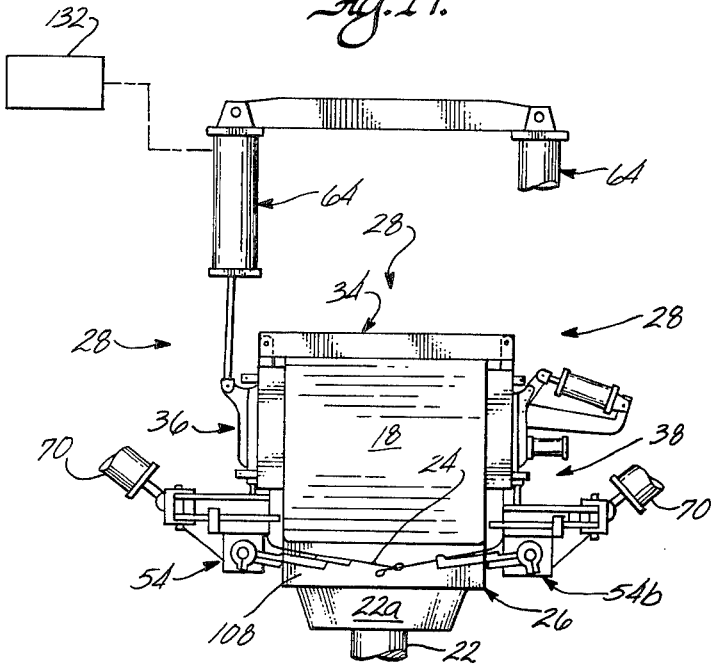
FIG. 17 is a schematic, fragmentary end view of the tying device of FIG. 10 at a third stage in the wire-tying operation after both the front and back side arm assemblies have been pivoted to their fully lowered positions.

When the first and second ends 30 and 32 of the wires 24 are engaged, as shown in FIG. 13, and the second bend assembly 38 has reached its fully lowered position (as is shown in FIG. 17), the control circuit automatically operates the pneumatic gripper assembly cylinders 84 (by means of a limit switch (not shown) on the assembly 38) on both of the finger assemblies. Operation of the pneumatic cylinders 84 opens all of the anvil assemblies 74 and releases the wires 24 from the wire bend assemblies 36 and 38. Although the wires are released from the wire bend assemblies when the anvil assemblies are opened, so long as the bend assemblies are in their fully lowered position, the wires are held in the position shown in FIG. 13.

After a selected time delay provided by the control circuit 132 that starts when the anvil assemblies are opened, the control circuit automatically operates the pneumatic cylinders 64 on the wire bend assembly 36 to start pivoting the assembly 36 from its fully lowered position to its fully raised position. As the assembly 36 begins moving up, it disengages the wires 24 to allow the loops 30 to spring back out of the pockets 140 and move in a direction toward the closer cavity opening 114*a*. Such movement continues until the ends 30 and 32 form a tight knot 144 (best seen in FIG. 14), which is stopped from further movement out of the cavity 114 by the stop 138. The knot 144 is directly below the enlarged portion 116*a* of the slot 116 so that the wire and knot formed therein can exit the closer cavity 114 through the slot.

As the first bend assembly 36 is being pivoted back up to its fully raised position, and after the knot 144 has been formed, the control circuit operates to begin pivoting the second wire bend assembly 38 back from its fully lowered position to its fully raised position. After the first and second arm assemblies have reached their fully raised positions, the control circuit 132 automatically operates the pneumatic cylinders 70 on both finger assemblies 54, and the pneumatic stretch cylinder 120 of the stretch assembly 118, to return the fingers to their fully raised position and to return the finger assembly 54*b* on the second wire bend assembly 38 to its unstretched position.

The workman then lowers the press ram which releases the compression on the bale 18, thereby allowing the bale to expand within the wires 24 which now tightly encircle the tied bale.

When both the first and second bend assemblies 36 and 8 have returned to their fully raised positions with the fingers up, and the stretch assembly 118 has repositioned the second assembly 38 into its unstretched configuration, the tying device 10 is ready to be loaded with another set of wires 24 for tying the next bale.

After the assemblies 36 and 38 have been returned to their fully raised position, as described in the preceding paragraph, the tied bale 18 is removed from the press, and the press doors are closed so that the wire loading and tying sequence can be repeated for the next bale.

The above description of a preferred embodiment of the wire-tying device 10, provided in accordance with this invention, and its automatic operation, is for illustrative purposes. Because of variations, which will be apparent to those skilled in the art, the present invention is not intended to be limited to the embodiment described above. The scope of the invention is defined in the following claims.

What is claimed is:

1. A tying device for mounting on a baling press for tying a wire having preformed interlocking ends around a bale formed in the press, the tying device comprising:

(a) a first wire bend assembly pivotally mounted on one side of the baling press for holding and bending the first preformed interlocking end of a wire downwardly around one side of the bale as the assembly pivots from its fully raised to its fully lowered position;

(b) a second wire bend assembly pivotally mounted on the opposite side of the baling press for holding and bending the second preformed interlocking end of the wire downwardly around the opposite side of the bale as the assembly pivots from its fully raised to its fully lowered position; and (c) a wire closer beneath such a bale comprising an elongated, open-ended cavity extending across the width of the closer, the first preformed interlocking end of the wire being inserted into the first open end of the cavity by the first wire bend assembly as the first assembly is pivoted downwardly, and the second interlocking end of the wire being inserted into the second open end of the cavity by the second wire bend assembly as the second assembly is pivoted downwardly, the wire closer additionally comprising means in which the first interlocking end of the wire is held by the first wire bend assembly as the second interlocking end of the wire is moved by the second wire bend assembly into interlocking engagement with the first end.

2. A tying device as claimed in claim 1 wherein at least one of the arm assemblies comprises means for stretching the wire tightly across the top of the bale.

3. A tying device as claimed in claim 1 wherein each such arm assembly comprises means for placing about a 90° bend in the wire adjacent both the first and second interlocking ends.

4. A tying device as claimed in claim 1 wherein the wire closer comprises a stop for placing a knot formed by the interlocking ends of the wire in proper position for removal from said wire closer.

5. A tying device as claimed in claim 1 wherein the means in the cavity in which the first interlocking end of the wire is held comprises a pocket.

6. A tying device for mounting on a baling press for tying a plurality of wires having preformed interlocking ends around a bale formed in the press, the tying device comprising:

(a) a first wire bend assembly pivotally mounted on one side of the baling press at an elevation above the chamber in which the bale is formed for bending one of the preformed interlocking ends of each of a plurality of wires around one side of the bale, the first wire bend assembly comprising:

(i) an arm assembly mounted on the press capable of being pivoted downwardly from a fully raised position, whereby the arm assembly extends generally horizontally away from the press to a fully lowered position; and (ii) a finger assembly mounted on the arm assembly, the finger assembly comprising a plurality of horizontally spaced-apart fingers, each of which can be pivoted downwardly from a fully raised position extending generally horizontally away from the press to a fully lowered position;

(b) a second wire bend assembly pivotally mounted on the opposite side of the baling press at about the same elevation as the elevation of the first wire bend assembly for bending the opposite preformed interlocking ends of each of the plurality of wires around the opposite side of the bale, the second wire bend assembly comprising:

(i) an arm assembly mounted on the press capable of being pivoted downwardly from a fully raised position extending generally horizontally away from the press to a fully lowered position; and (ii) a finger assembly mounted on the arm assembly, the finger assembly comprising a plurality of horizontally spaced-apart fingers, each of which can be pivoted downwardly from a fully raised position extending generally horizontally away from the press to a lowered position, each such finger on the first wire bend assembly being associated with a counterpart finger on the second wire bend assembly, the first and second wire bend assemblies constructed so that when their associated arm assemblies and the fingers of their associated finger assemblies are in their fully raised positions, and the wires to be tied around the bale are positioned in the tying device for tying, each such wire is held on one end by one of the fingers of the first wire bend assembly and extends above the chamber in which the bale is formed so that the second end of such a wire is underneath the counterpart finger on the second wire bend assembly; and (c) a wire closer assembly mounted on the press having a top surface which forms the floor of the chamber in which the bale is formed and against which the bale is compressed, the wire closer assembly comprising a plurality of horizontally spaced wire closers, each of which comprises a cavity open on both ends for insertion of the opposed preformed interlocking ends of one of the wires and means in the cavity for joining the opposed preformed interlocking ends of each such wire together as such a wire is bent around the bale and its opposed preformed interlocking ends are inserted into the open ends of the cavity of the associated wire closer by the combined action of the finger assembly fingers and the arm assemblies as such fingers and arm assemblies are pivoted from their fully raised to their fully lowered positions.

7. A tying device as claimed in claim 6 wherein both the first and second wire bend assemblies comprise means for guiding the wires into proper position on the tying device during manual loading.

8. A tying device as claimed in claim 7 wherein the wire guide means comprises a first guide tube assembly mounted on the arm assembly of the first wire bend assembly and a second guide tube assembly mounted on the arm assembly of the second wire bend assembly, each such guide tube assembly comprising a plurality of interconnected horizontally spaced-apart, elongated hollow guide tubes open at both ends, wherein each individual guide tube is associated with one of the fingers and is aligned in a direction about parallel to such a finger when the finger is in its fully raised position, the wires, when in position on the tying device for tying around the bale, extending through such guide tubes.

9. A tying device as claimed in claim 8 wherein the first wire bend assembly comprises means for gripping each such wire to be tied around the bale adjacent the first interlocking end of such a wire, and the second wire bend assembly comprises means for gripping each such wire to be tied around the bale adjacent the second interlocking end of such a wire so that the wires are maintained in proper as they are being bent around the bale and their ends are being inserted into and joined together in the wire closers, and wherein the second guide tube assembly is on the opposite side of the press from which the wires are loaded into the tying device, the second wire bend assembly additionally comprising means for raising the second guide tube assembly from a first relatively lower position where the wire in each such guide tube extends from such a tube to a position below the open gripping means in which the wire is to be secured to a second relatively higher position, whereby the wires are lifted into place in the open gripping means ready to be secured upon closure of said gripping means.

10. A tying device as claimed in claim 8 additionally comprising a center plate mounted on the press wherein the bottom surface of the center plate forms the roof of the chamber in which the bale is formed and against which the bale is compressed, the first wire bend assembly being pivotally mounted on one side of the center plate and the second wire bend assembly being pivotally mounted on the opposite side of the center plate.

11. A tying device as claimed in claim 10 wherein the wire guide means additionally comprises a plurality of elongated cavities open at both ends extending across the width of the center plate, wherein each such wire to be tied is mounted on the tying device by inserting one end of the wire through such an elongated cavity and, when so mounted, the wire extends through the cavity.

12. A tying device as claimed in claim 6 wherein the finger assembly of the first wire bend assembly comprises means for gripping each such wire to be tied around the bale adjacent the first end of such a wire, and the finger assembly of the second wire bend assembly comprises means for gripping each such wire to be tied around the bale adjacent the opposite end of such a wire so that the wires are maintained in proper position as they are bent around the bale and their ends are inserted into and joined together in the wire closers.

13. A tying device as claimed in claim 12 wherein the wire gripping means comprises a first gripper structure mounted on the first wire bend assembly and a second gripper structure mounted on the second wire bend assembly, each such gripper structure comprising a plurality of anvil assemblies, each comprising an anvil block, an anvil, and a pivotally mounted anvil arm, wherein such an anvil arm, when pivoted to a first position, opens the anvil assembly so that a wire can be positioned above the anvil in the anvil assembly and wherein such an anvil arm, when pivoted to a second position, closes the anvil assembly to thereby hold the wire securely in place therein so that such a wire can be bent around the anvil by the finger associated with that wire when such a finger is pivoted from its fully raised to its fully lowered position.

14. A tying device as claimed in claim 13 wherein at least one of the wire bend assemblies comprises means for stretching the wires tightly across the top of the bale as the wires are being bent around the bale.

15. A tying device as claimed in claim 14 wherein such a wire stretching means comprises means for moving the gripper structure on at least one of the finger assemblies away from its associated arm assembly so that the distance between the gripper structure on the first wire bend assembly and the gripper structure on the second wire bend assembly can be increased after the wires have been secured in the gripper structures.

16. A tying device as claimed in claim 13 wherein each such anvil assembly arm comprises an adjustable screw extending therethrough so that when the anvil arm is pivoted to its closed position, the wire is held securely in place in the anvil assembly between the end of the adjustable screw and the anvil block.

17. A tying device as claimed in claim 13 wherein each such anvil assembly comprises a spring which biases the anvil assembly arm toward its closed position for holding the wire securely in position between the anvil arm and anvil block.

18. A tying device as claimed in claim 6 wherein at least one of the wire bend assemblies comprises means for stretching the wires tightly across the top of the bale as the wires are being bent around the bale.

19. A tying device as claimed in claim 6 additionally comprising a control circuit which provides for automatic operation of the tying device for tying the plurality of wires around the bale by the steps of:

(a) operating the finger assemblies to thereby pivot the fingers on the finger assemblies downwardly from their fully raised to their fully lowered position to thereby form bends in the wires adjacent both the first and second preformed ends of such a wire; thereafter (b) starting pivoting the first wire bend assembly downwardly to thereby begin bending the first preformed ends of the wires downwardly around one side of the bale; and after a selected time delay (c) starting pivoting the second wire bend assembly downwardly to thereby begin bending the second preformed ends of the wires downwardly around the other side of the bale, the time delay between the start of pivoting the first wire bend assembly and the start of pivoting the second wire bend assembly being sufficient to provide that the first wire bend assembly is in its fully lowered position holding the first preformed ends of the wires securely in position in the wire closers while the second wire bend assembly continues pivoting toward its fully lowered position, thereby moving the second preformed ends of the wires into the wire closers for engaging and joining the second ends with the previously positioned first ends.

20. A tying device as claimed in claim 19 wherein the control circuit additionally operates to start pivoting the first wire bend assembly from its fully lowered position to its raised position and, after a selected time delay, operates to start pivoting the second wire bend assembly from its fully lowered position to its raised position.

21. A tying device for mounting on a baling press for tying a plurality of wires with preformed interlocking ends around a bale being formed in the press, the tying device comprising:

(a) a center plate mounted on the baling press having a bottom surface which comprises the roof of a chamber in which the bale is formed and against which the bale is compressed, the center plate including a plurality of horizontally spaced-apart, open-ended channels extending across its width through which the wires to be tied around the bale are inserted during a manual wire-loading operation, each such channel having an elongated slot in its bottom surface extending across the width of the center plate for removal of the wire from the channel during the tying operation;

(b) a first wire bend assembly pivotally mounted on one side of the center plate comprising:

(i) an arm assembly mounted on the center plate capable of being pivoted downwardly from a fully raised position to a fully lowered postion; and (ii) a finger assembly mounted on the arm assembly, the finger assembly comprising a plurality of horizontally spaced-apart fingers, each of which can be pivoted downwardly from a fully raised position to a fully lowered position;

(c) a second wire bend assembly pivotally mounted on the opposite side of the center plate comprising:

(i) an arm assembly mounted on the center plate capable of being pivoted downwardly from a fully raised position to a fully lowered position; and (ii) a finger assembly mounted on the arm assembly, the finger assembly comprising a plurality of horizontally spaced-apart fingers each of which can be pivoted downwardly from a fully raised position to a fully lowered position, each such finger on the first wire bend assembly being associated with a counterpart finger on the second wire bend assembly, the wire bend assemblies constructed so that when both the arm assemblies and fingers comprising the first and second wire bend assemblies are in their fully raised positions, and the wires to be tied around the bale are positioned in the tying device for tying, each such wire is held on one end by one of the fingers of the first wire bend assembly and extends across the baling press through one of the spaced-apart channels in the center plate so that the second end of such a wire is underneath the counterpart finger on the second wire bend assembly; and (d) a wire closer assembly mounted on the press having a top surface which forms the floor of the chamber in which the bale is formed and against which the bale is compressed, the wire closer assembly comprising a plurality of horizontally spaced wire closers, each of which comprises a cavity open on both ends for insertion of the opposed ends of one of the wires and means in the cavity for joining the opposed ends of each such wire together as such a wire is bent around the bale and its opposed ends are inserted into the open ends of such a cavity by the combined action of the finger assembly fingers and the arm assemblies as such fingers and the arm assemblies are pivoted from their fully raised to their fully lowered positions.

22. A tying device as claimed in claim 21 wherein each such wire closer comprises means for holding the first preformed interlocking end of such a wire in proper position therein so that when the second preformed interlocking end of such a wire is inserted into the wire closer, such interlocking ends are joined together.

23. A tying device as claimed in claim 21 wherein each such wire closer assembly comprises a pocket for holding the first preformed interlocking end of such a wire in position therein, and a groove in which the second preformed interlocking end travels as such a second interlocking end is inserted into the wire closer and engaged with the first interlocking end.

24. A tying device as claimed in claim 23 wherein each such wire closer additionally comprises a stop for positioning the knot formed by the interlocking ends of the wire in proper position for removal from the closer.

25. A tying device as claimed in claim 21 wherein both the first and second wire bend assemblies comprise means for guiding the wires into proper position on the tying device during manual loading.

26. A tying device as claimed in claim 25 wherein the wire guide means comprises a first guide tube assembly mounted on the arm assembly of the first wire bend assembly and a second guide tube assembly mounted on the arm assembly of the second wire bend assembly, each such guide tube assembly comprising a plurality of interconnected horizontally spaced-apart, elongated, hollow guide tubes open at both ends, wherein each individual guide tube is associated with one of the fingers and is aligned in a direction about parallel to such a finger when the finger is in its fully raised position, the wires, when in position on the tying device for tying around the bale, extending through such guide tubes.

27. A tying device as claimed in claim 26 wherein the first wire bend assembly comprises means for gripping each such wire to be tied around the bale adjacent the first interlocking end of such a wire, and the second wire bend assembly comprises means for gripping each such wire to be tied around the bale adjacent the second interlocking end of such a wire so that the wires are maintained in proper position as they are being bent around the bale and their ends are being inserted into and joined together in the wire closers, and wherein the second guide tube assembly is on the opposite side of the press from which the wires are loaded into the tying device, the second wire bend assembly additionally comprising means for raising the second guide tube assembly from a first relatively lower position where the wire in each such guide tube extends from such a tube to a position below the open gripping means in which the wire is to be secured to a second relatively higher position, whereby the wires are lifted into place in the open gripping means ready to be secured upon closure of said gripping means.

28. A tying device as claimed in claim 21 wherein at least one of the wire bend assemblies comprises means for stretching the wires tightly across the top of the bale as the wires are being bent around the bale.

29. A tying device as claimed in claim 21 additionally comprising a control circuit which provides for automatic operation of the tying device for tying the plurality of wires around the bale by the steps of:

(a) operating the finger assemblies to thereby pivot the fingers on the finger assemblies downwardly from their fully raised to their fully lowered position to thereby form bends in the wires adjacent both the first and second preformed ends of such a wire; thereafter (b) starting pivoting the first wire bend assembly downwardly to thereby begin bending the first preformed ends of the wires downwardly around one side of the bale; and after a selected time delay (c) starting pivoting the second wire bend assembly downwardly to thereby begin bending the second preformed ends of the wires downwardly around the other side of the bale, the time delay between the start of pivoting the first wire bend assembly and the start of pivoting the second wire bend assembly being sufficient to provide that the first wire bend assembly is in its fully lowered position holding the first preformed ends of the wires in position in the wire closers while the second wire bend assembly continues pivoting towards its fully lowered position, thereby moving the second preformed ends of the wires into the wire closers for engaging and joining the second ends with the previously positioned first ends.

* * * * *